US011537069B2

(12) United States Patent
Hasegawa

(10) Patent No.: US 11,537,069 B2
(45) Date of Patent: Dec. 27, 2022

(54) IMAGE FORMING APPARATUS AND METHOD

(71) Applicant: TOSHIBA TEC KABUSHIKI KAISHA, Tokyo (JP)

(72) Inventor: Satoshi Hasegawa, Tagata Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/307,705

(22) Filed: May 4, 2021

(65) Prior Publication Data

US 2021/0263452 A1 Aug. 26, 2021

Related U.S. Application Data

(63) Continuation of application No. 16/801,770, filed on Feb. 26, 2020, now Pat. No. 11,029,628.

(51) Int. Cl.
*G03G 15/20* (2006.01)

(52) U.S. Cl.
CPC ..... *G03G 15/2039* (2013.01); *G03G 15/2064* (2013.01); *G03G 2215/00177* (2013.01)

(58) Field of Classification Search
CPC ..... G03G 15/2039; G03G 15/2064; G03G 2215/00177; G03G 15/2042
See application file for complete search history.

(56) References Cited

U.S. PATENT DOCUMENTS

2011/0206402 A1 8/2011 Yamashina
2014/0016958 A1 1/2014 Yabuuchi et al.
2014/0227000 A1* 8/2014 Kitahara ..... G03G 15/2039 399/69
2014/0270835 A1* 9/2014 Umezawa ..... G03G 15/2042 399/69

FOREIGN PATENT DOCUMENTS

JP 2000-162910 A 6/2000
JP 2009098361 A * 5/2009

* cited by examiner

*Primary Examiner* — G. M. A Hyder
(74) *Attorney, Agent, or Firm* — Kim & Stewart LLP

(57) ABSTRACT

An image forming apparatus includes an image forming device, a heater, and a controller. The image forming device is configured to generate a laser scanning beam based on the image data to form a toner image on a sheet. The heater is configured to heat the sheet. The heater includes heater elements arranged in a direction corresponding to the main scanning direction of the laser scanning. The controller is configured to selectively control the heater elements to be energized at an energization start timing based on the image data and a signal from the image forming device indicating a start of scanning by the laser scanning beam in the main scanning direction.

18 Claims, 6 Drawing Sheets

IMAGE FORMING APPARATUS AND METHOD

CROSS-REFERENCE TO RELATED APPLICATION

This application is continuation of U.S. patent application Ser. No. 16/801,770, filed on Feb. 26, 2020, the entire contents of each of which are incorporated herein by reference.

FIELD

Embodiments described herein relate generally to an image forming apparatus and an image forming method.

BACKGROUND

In the related art, an on-demand-type fixing device is known as a fixing device of an image forming apparatus that enables energy saving. In on-demand-type fixing devices, a plurality of heat sources are mounted along a main scanning direction and the heat sources are selectively heated in accordance with positioning of an image region being printed. However, when the heat sources are to be selectively heated in accordance with various sub-image regions having toner thereon, it is necessary for a fixing control unit that controls selective heating of the heat sources to analyze image data corresponding to the image region to identify these sub-image regions having toner thereon in advance. That is, it is generally necessary to supply image data, or otherwise notify sub-image region positions, to the fixing control unit in advance from a main image forming control unit or the like. As a result, a printing start time may be delayed.

DETAILED DESCRIPTION

In general, according to an embodiment, an image forming apparatus includes an image forming device, a heater, and a controller. The image forming device is configured to generate a laser scanning beam based on the image data to form a toner image on a sheet. The heater is configured to heat the sheet to fix the toner image to the sheet. The heater includes a plurality heater elements adjacently arranged in a direction corresponding to the main scanning direction of the laser scanning beam during image formation processing in the image forming device. The controller is configured to selectively control the heater elements to be energized and at an energization start timing based on the image data and a signal from the image forming device indicating a start of scanning by the laser scanning beam along a row of the image in the main scanning direction.

Hereinafter, an image forming apparatus and a control method thereof according to example embodiments will be described with reference to the drawings.

Figure 1:
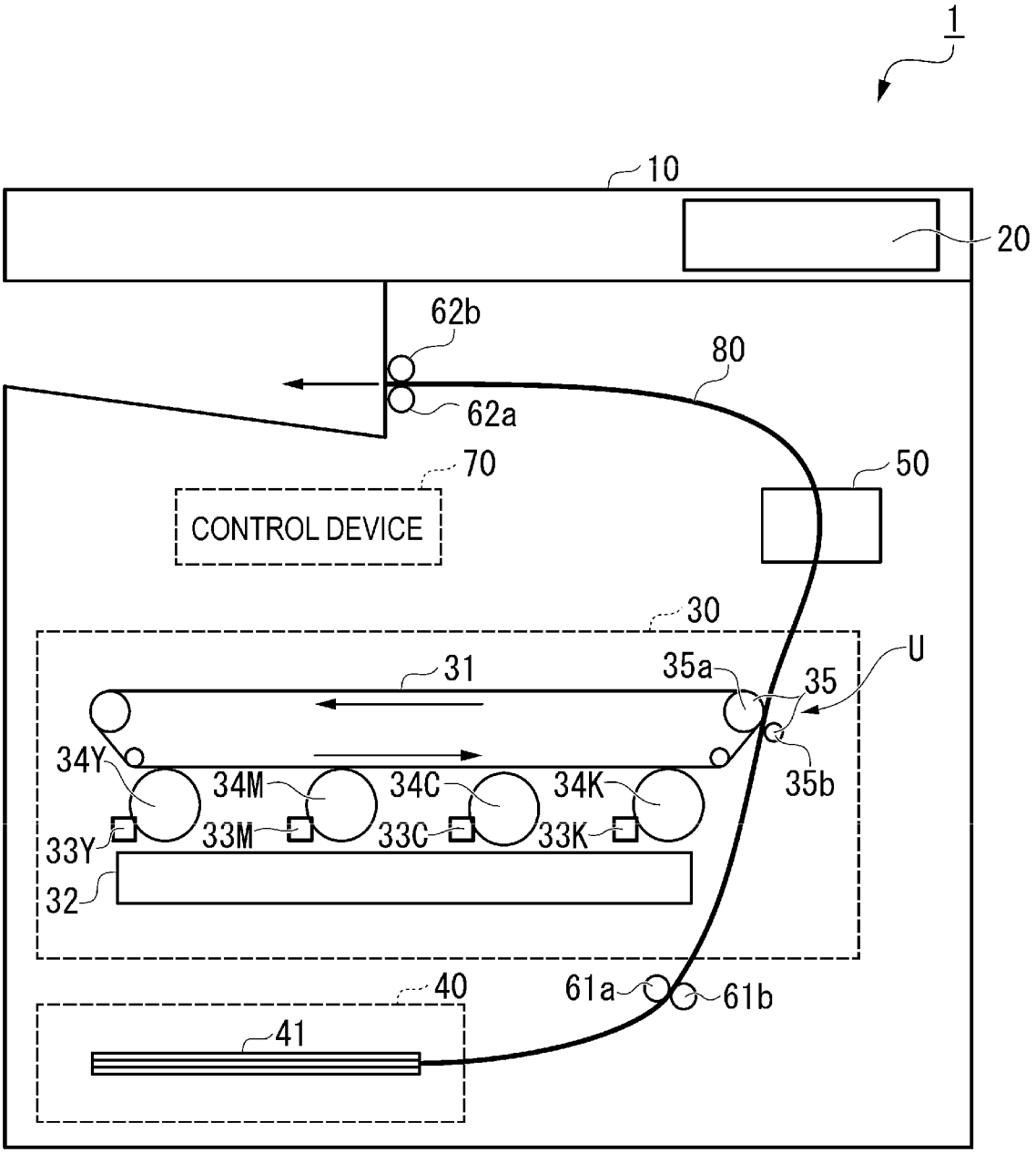
FIG. 1 illustrates an example of an entire configuration of an image forming apparatus according to an embodiment.

FIG. 1 illustrates an example of an overall configuration of an image forming apparatus 1 according to an embodiment. The image forming apparatus 1 in this example is a multi-function peripheral (MFP). The image forming apparatus 1 performs printing by performing an image forming process and an image fixing process. The image forming process is a process of forming an image (e.g., a toner image) on a sheet. The image fixing process is a process of fixing the image formed on the sheet to the sheet. The sheet is, for example, a sheet of paper on which text, an image, or the like can be formed. In general, the sheet may be any object or material as long as the image forming apparatus 1 can form an image thereon.

The image forming apparatus 1 includes an image reading unit 10, a control panel 20, an image forming unit 30, a sheet accommodation unit 40, a fixer 50, conveyance rollers 61*a* and 61*b*, discharging rollers 62*a* and 62*b*, and a control device 70.

The image reading unit 10 reads a reading target image from a document as brightness and darkness of reflected light and generate image data from the target image. For example, the image reading unit 10 reads an image printed on a reading target sheet that has been set on a document reading platen or the like. The image reading unit 10 records the generated image data. The image data may be transmitted to another information processing apparatus via a network. The image data may be formed as print data in the form of an image on a sheet by the image forming unit 30.

The control panel 20 includes a display unit and an operation unit. The display unit is a display device such as a liquid crystal display and an organic electro-luminescence (EL) display. The display unit displays various kinds of information regarding the image forming apparatus 1 under the control of the control device 70. The operation unit includes a plurality of buttons. The operation unit receives an operation by a user. For example, the operation unit receives an instruction to perform printing. The operation unit outputs a signal to the control device 70 in response to an operation performed by the user. The display unit and the operation unit may be configured as an integrated touch panel.

The image forming unit 30 performs an image forming process. The image forming unit 30 may be referred to as an image forming device. Specifically, the image forming unit 30 forms an image on a sheet based on image information (data) generated by the image reading unit 10 or image information (data) received via a network communication path or the like. For example, the image forming unit 30 forms a toner image on a sheet using toner.

The image forming unit 30 includes a transfer belt 31, an exposure unit 32, a plurality of developers (33Y, 33M, 33C, and 33K), a plurality of photoconductive drums (34Y, 34M, 34C, and 34K), and a transfer unit 35.

The transfer belt 31 is an endless intermediate transfer. The transfer belt 31 rotates in a direction indicated by an arrow by rotation of rollers (counterclockwise rotate).

The exposure unit 32 is provided at a position facing the photoconductive drums 34 between the developers 33 and chargers (not separately illustrated). The exposure unit 32 irradiates the surfaces (photoconductive layers) of the photoconductive drums 34Y, 34M, 34C, and 34K with laser beam based on image data. More specifically, exposure image data is generated based on the image data, and the laser beam exposure is based on the exposure image data. In a specific embodiment, the exposure image data is binary image data. In a specific embodiment, the laser beam is generated when a part of the binary image data corresponding to a pixel is 1, and not generated when the part of the binary image data is 0. In various embodiments, the image forming unit 30, the fixer 50 (e.g., a fixing control circuit), or the control device 70 may perform the conversion to the exposure image data.

A direction along which the laser light is scanned on the photoconductive drums is a main scanning direction and a direction orthogonal to the main scanning direction is a sub-scanning direction. For example, in this embodiment, the main scanning direction matches an axial direction of the photoconductive drum and the sub-scanning direction matches a rotation direction of the transfer belt.

The irradiation of the laser light leads to a loss of charges on the surfaces (the photoconductive layers) of the photoconductive drums 34Y, 34M, 34C, and 34K. As a result, on the surface of each of the photoconductive drums 34Y, 34M, 34C, and 34K, an electrostatic pattern is formed at a position which is irradiated with the laser light. That is, by allowing the exposure unit 32 to irradiate the laser light, an electrostatic latent image is formed on the surface of each of the photoconductive drums 34Y, 34M, 34C, and 34K. The exposure unit 32 may use light of a light emitting diode (LED) instead of the laser light. The light emission of the exposure unit 32 is controlled based on the exposure image data under the control of the control device 70.

The exposure unit 32 includes a plurality of beam control units (not separately illustrated). The plurality of beam control units detect an image forming start timing along the main scanning direction and provide signals (hereinafter referred to as "BD signals") indicating the image forming start timing along the main scanning direction. The detection of an image forming start timing by a beam control unit may be based on receiving a signal based on image data for controlling an output of a laser exposure unit or the like. In the following description, four beam control units (e.g., first, second, third, and fourth beam control units) will be described as examples of the plurality of beam control units.

For example, the first beam control unit outputs a BD signal indicating an image forming timing of yellow (Y) (hereinafter referred to as an "YBD signal"). For example, the second beam control unit outputs a BD signal indicating an image forming timing of magenta (M) (hereinafter referred to as an "MBD signal"). For example, the third beam control unit outputs a BD signal indicating an image forming timing of cyan (C) (hereinafter referred to as a "CBD signal"). For example, the fourth beam control unit outputs a BD signal indicating an image forming timing of black (K) (hereinafter referred to as a "KBD signal").

The developers 33Y, 33M, 33C, and 33K supply toner to the photoconductive drums 34Y, 34M, 34C, and 34K, respectively. For example, the developer 33Y develops an electrostatic latent image on the surface of the photoconductive drum 34Y by yellow (Y). The developer 33M develops an electrostatic latent image on the surface of the photoconductive drum 34M by magenta (M). The developer 33C develops an electrostatic latent image on the surface of the photoconductive drum 34C by cyan (C). The developer 33K develops an electrostatic latent image on the surface of the photoconductive drum 34K by toner of black (K).

The developers 33Y, 33M, 33C, and 33K form toner images as visible images on the photoconductive drums 34Y, 34M, 34C, and 34K, respectively. The toner images formed on the photoconductive drums 34Y, 34M, 34C, and 34K are transferred to the transfer belt 31 (primary transfer) by a plurality of first transfer rollers. The plurality of first transfer rollers are provided at positions facing the photoconductive drums 34Y, 34M, 34C, and 34K with the transfer belt 31 interposed therebetween.

The transfer unit 35 includes a support roller 35*a* and a secondary transfer roller 35*b*. The transfer unit 35 transfers the toner images on the transfer belt 31 to a sheet 41 at a secondary transfer position U. The secondary transfer position U is a position at which the support roller 35*a* and the secondary transfer roller 35*b* face each other with the transfer belt 31 interposed therebetween. The transfer unit 35 gives a transfer bias controlled in accordance with a transfer current to the transfer belt 31. The transfer unit 35 transfers the toner image on the transfer belt 31 to the sheet 41 by a transfer bias. The transfer current is controlled by the control device 70.

The sheet accommodation unit 40 can include a single paper feed cassette or a plurality of paper feed cassettes. Each paper feed cassette accommodates a predetermined kind of sheets 41 with a predetermined size. The paper feed cassette includes a pickup roller. The pickup roller picks up the sheets 41 one by one from the paper feed cassette. The pickup roller supplies the sheet 41 picked up to a conveyance unit 80.

The fixer 50 performs an image fixing process. Specifically, the fixer 50 fixes an image (for example, a toner image) formed on the sheet 41 to the sheet 41 by heating and pressing the sheet 41. The fixer 50 according to this embodiment includes a heating unit that includes a plurality of heater elements that are disposed along the main scanning direction and are able to be controlled to heat independently for each predetermined heating region. The heater elements each generate heat by individual conduction. That is, the selectively turned on heater elements generate heat and the selectively turned off heater elements do not generate heat. The heater elements supply heat to the sheet 41 for fixing.

The conveyance rollers 61*a* and 61*b* supply the sheet 41 fed from the paper feed cassette to the image forming unit 30. The conveyance rollers 61*a* and 61*b* are installed at mutually facing positions.

The discharging rollers 62*a* and 62*b* discharge the sheet 41 on which an image has been fixed by the fixer 50 to a discharging unit. The discharging rollers 62*a* and 62*b* are installed mutually facing positions.

The control device 70 controls each functional unit of the image forming apparatus 1.

The conveyance unit 80 conveys the sheet 41. The conveyance unit 80 includes a transport path and a plurality of rollers along the transport path at various points. The transport path is a path along which the sheet 41 is transported during processing. The various rollers are rotated under the control of the control device 70 to convey the sheet 41 as appropriate along the path.

Figure 2:
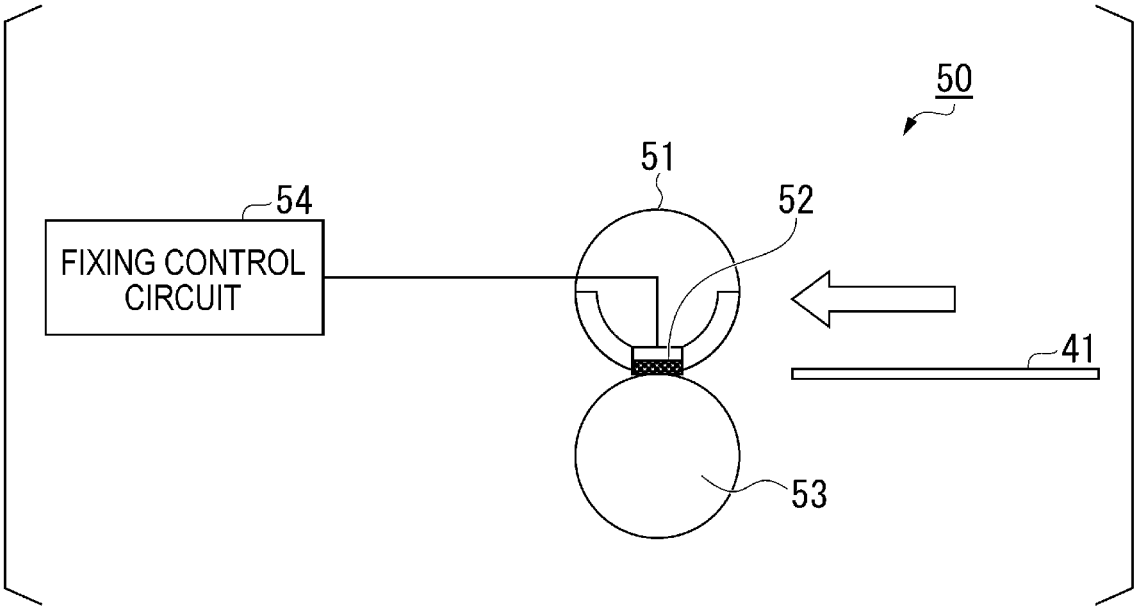
FIG. 2 is a diagram illustrating an internal configuration of a fixer.

FIG. 2 is a diagram illustrating an internal configuration of the fixer 50 according to this embodiment. The fixer 50 includes a fixing belt 51, a heating unit 52, a press roller 53, and a fixing control circuit 54.

The fixing belt 51 is pressed by the press roller 53 to form a fixing nip. The fixing belt 51 fixes toner to the sheet 41 through heating of the heating unit 52.

The heating unit 52 heats a sheet. The heating unit 52 may be referred to as a heater. The heating unit 52 includes a plurality of heater elements 55-1 to 55-N (where N is an integer equal to or greater than 2) in the main scanning direction. The plurality of heater elements 55-1 to 55-N are independently controlled for heating through the switching of switches. For example, the heating unit 52 is a heating source that includes the plurality of heater elements 55-1 to 55-N. Individual identification information is designated for each of the plurality of heater elements 55-1 to 55-N, and thus the heater elements 55-1 to 55-N can be separately distinguished from each other. In the following description, when the heater elements 55-1 to 55-N are not being distinguished from each other, the heater elements 55-1 to 55-N may be referred to as heater elements 55 collectively or a heater element 55 individually.

The press roller 53 presses the sheet 41 against the heating unit 52. The press roller 53 is provided at a position facing the heating unit 52.

The fixing control circuit 54 controls a heating timing of a target heater element based on exposure image data used in the image forming unit 30. The fixing control circuit 54 may be referred to as a controller. The target heater element is a heater element from among the plurality of heater elements 55-1 to 55-N that is to be heating (controlled to be turned on). The fixing control circuit 54 determines a heating timing for a target heater element based on a time necessary for conveyance from an exposure position to a heating position and a pre-startup time of the target heater element. More specifically, the fixing control circuit 54 subtracts the pre-startup time from the time necessary for conveyance to determine a heating timing of the target heater element. The time necessary for conveyance from the exposure position to the heating position corresponds to a delay time in heating of the fixer 50.

The fixing control circuit 54 supplies power to the target heater element to allow the target heater element to generate heat. Conversely, the fixing control circuit 54 blocks supply of power to a heater element other than the target heater element (hereinafter referred to as a "non-target heater element"). For example, a power supply source and each heater element may be connected via an individual switch.

In this case, the fixing control circuit 54 connects the power supply source and the target heater element to supply power to the target heater element by turning on the switch connected to the target heater element. Thus, the target heater element generates heat. The fixing control circuit 54 does not conduct the power supply source and a non-target heater element to block supply of power to the non-target heater element by turning off the switch connected to the non-target heater element. Thus, the non-target heater element does not generate heat.

Figure 3:
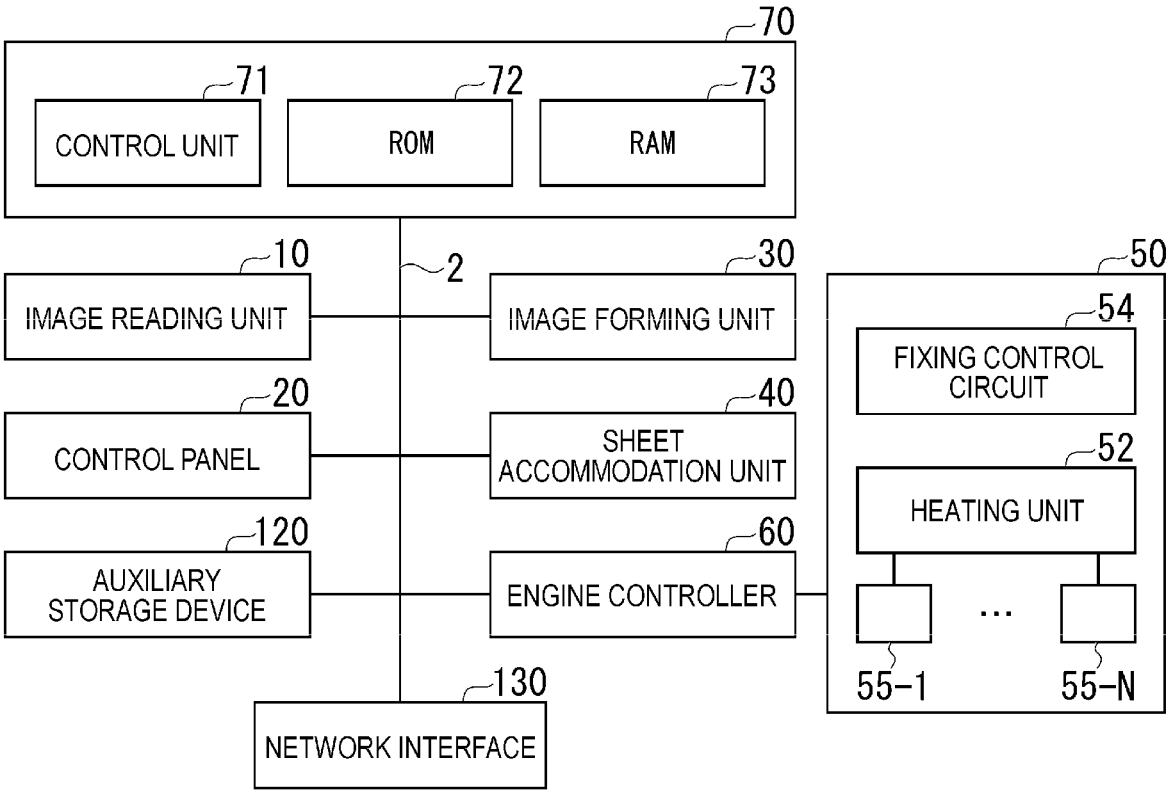
FIG. 3 is a block diagram illustrating a hardware configuration of an image forming apparatus according to an embodiment.

FIG. 3 is a block diagram illustrating a hardware configuration of the image forming apparatus 1 according to the embodiment. In FIG. 3, only a specific hardware configuration of the image forming apparatus 1 according to the embodiment is illustrated.

The image forming apparatus 1 includes the image reading unit 10, the control panel 20, the image forming unit 30, the sheet accommodation unit 40, the fixer 50, an engine controller 60, the control device 70, an auxiliary storage device 120, and a network interface 130. Each functional unit is connected to be able to perform data communication via a system bus 2.

The image reading unit 10, the control panel 20, the image forming unit 30, and the sheet accommodation unit 40 will be not described. Hereinafter, the fixer 50, the engine controller 60, the control device 70, the auxiliary storage device 120, and the network interface 130 will be described.

Figure 4:
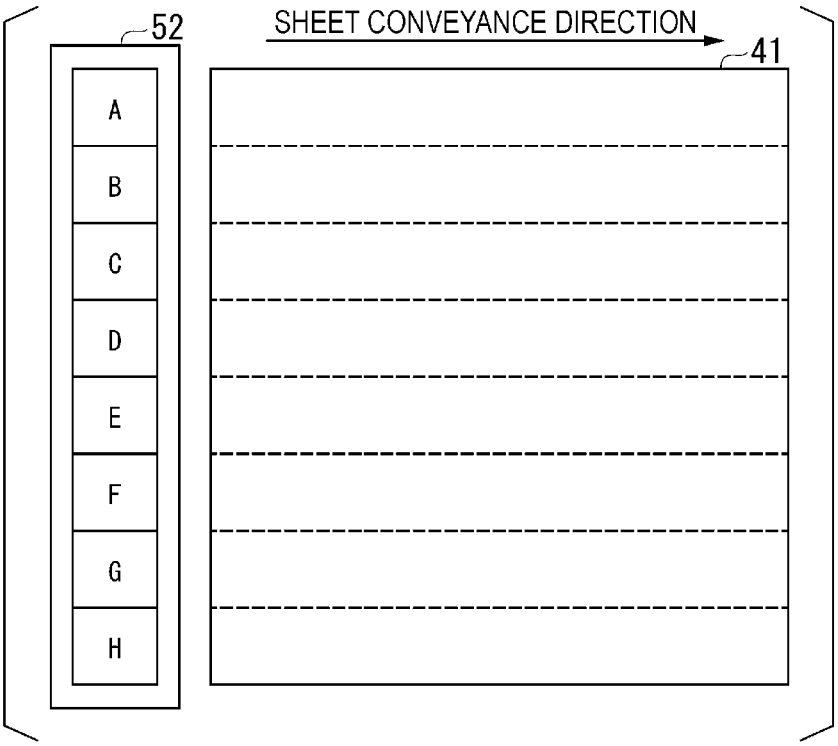
FIG. 4 is a diagram illustrating an example of heating regions of a plurality of heater elements included in a heating unit.

FIG. 4 is a diagram illustrating an example of heating regions of the plurality of heater elements 55-1 to 55-N included in the heating unit 52 according to the embodiment. In the embodiment, the heating unit 52 including eight heater elements 55-1 to 55-8 will be described as an example, but the number of heater elements 55 is not limited thereto. The heater elements 55-1 to 55-8 each heat ranges indicated by regions A to H. For example, the heater element 55-1 heats the range indicated by the region A. Similarly, the heater element 55-2 heats the range indicated by the region B. The heater element 55-3 heats the range indicated by the region C. The heater element 55-4 heats the range indicated by the region D. The heater element 55-5 heats the range indicated by the region E. The heater element 55-6 heats the range indicated by the region F. The heater element 55-7 heats the range indicated by the region G. The heater element 55-8 heats the range indicated by the region H.

The engine controller 60 is a controller that controls the fixer 50. The engine controller 60 controls the fixer 50 based on the BD signals output from the beam control units included in the image forming unit 30. The engine controller 60 includes a plurality of pixel counters 601 to 604, as illustrated in FIG. 5.

Figure 5:
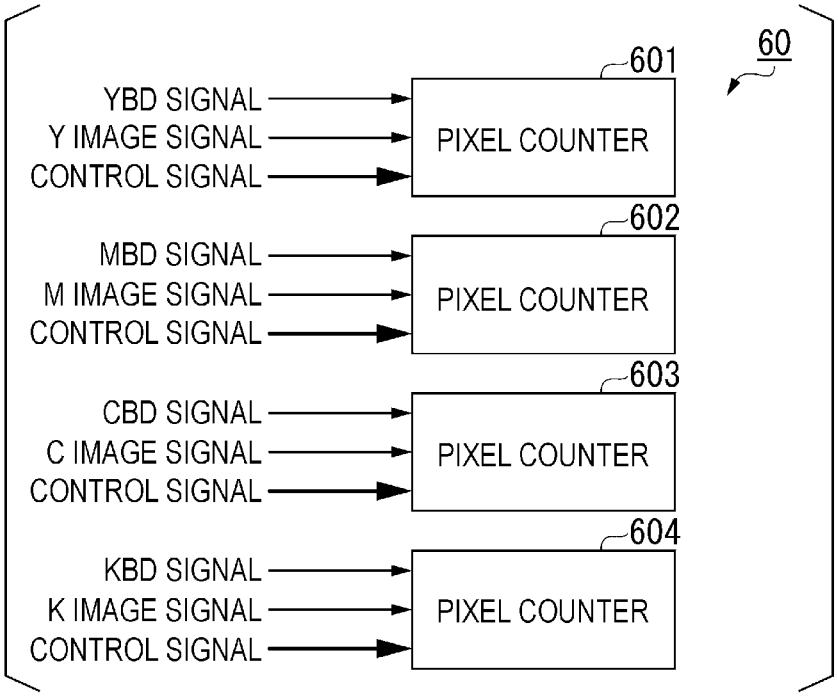
FIG. 5 is a diagram illustrating an internal configuration of an engine controller.

FIG. 5 is a diagram illustrating an internal configuration of the engine controller 60 according to the embodiment. The pixel counters 601 to 604 count the number of pixels in an image included in the exposure image data for each color within a predetermined region. The predetermined region is one region of the plurality of regions generated by partitioning the exposure image data into predetermined partitions in a main scanning direction and a sub-scanning direction. The pixel counters 601 to 604 are provided to correspond to each color, respectively.

The pixel counter 601 receives a YBD signal corresponding to a detection by the first beam control unit. The pixel counter 601 performs a count for a first interval, which corresponds to a sub-image region described below, starting from the time point at which the YBD signal is received. The pixel counter 601 also receives a signal corresponding to image information for yellow (Y) included in the exposure image information (hereinafter referred to as a "Y image signal"). The pixel counter 601 counts the number of pixels of yellow (Y) based on the received Y image signal. The pixel counter 601 performs operations in accordance with an input control signal.

The pixel counter 602 receives an MBD signal corresponding to a detection by the second beam control unit. The pixel counter 602 performs a count for the first interval starting from the time point at which the MBD signal is received. The pixel counter 602 also receives a signal corresponding to image information for magenta (M) included in the exposure image information (hereinafter referred to as an "M image signal"). The pixel counter 602 counts the number of pixels of magenta (M) based on the received M image signal. The pixel counter 602 performs operations in accordance with an input control signal.

The pixel counter 603 receives a CBD signal corresponding to a detection by the third beam control unit. The pixel counter 603 performs a count for the first interval starting from the time point at which the CBD signal is received. The pixel counter 603 also receives a signal corresponding to image information for cyan (C) included in the exposure image information (hereinafter referred to as a "C image signal"). Then, the pixel counter 603 counts the number of pixels of cyan (C) based on the C image signal. The pixel counter 603 performs an operation in accordance with an input control signal.

The pixel counter 604 receives a KBD signal corresponding to a detection by the fourth beam control unit. The pixel counter 604 performs a count for the first interval starting from the time point at which the KBD signal is received. The pixel counter 604 also receives a signal corresponding image information for black (K) included in the exposure image information (hereinafter referred to as a "K image signal"). The pixel counter 604 counts the number of pixels of black (K) based on the received K image signal. The pixel counter 604 performs operations in accordance with an input control signal.

Referring back to FIG. 3, description of the image forming apparatus 1 will be continued.

The control device 70 includes a control unit 71, a read-only memory (ROM) 72, and a random access memory (RAM) 73. The control unit 71 is, for example, a processor such as a central processing unit (CPU) or a graphics processing unit (GPU). The control unit 71 controls operations of each functional unit of the image forming apparatus 1. The control unit 71 performs various processes by loading a program stored in the ROM 72 on the RAM 73 and then executing the program. An application specific integrated circuit (ASIC) may serve in some instances to perform or realize a function otherwise described as being performed by the control unit 71. The ASIC is a dedicated circuit configured to perform a specific function and the control unit 71 may incorporate such a dedicated circuit in some embodiments.

In this embodiment, the ROM 72 stores a program that causes the control unit 71 to operate as described in the present disclosure. The RAM 73 is a memory that temporarily stores data used by each functional unit included in the image forming apparatus 1. The RAM 73 may store digital data generated by the image reading unit 10. The RAM 73 may temporarily store work parameters and a work log.

The auxiliary storage device 120 is, for example, a hard disk or a solid-state drive (SSD) and stores various kinds of data. The various kinds of data are, for example, digital data, work parameters, and a work log.

The network interface 130 transmits and receives data to and from another device. Here, the other device is, for example, an information processing device such as a personal computer. In some examples, the network interface 130 operates as an input interface and receives print data or an instruction transmitted from another device. The instruction transmitted from the other device can be an instruction to perform printing, or the like. The network interface 130 also operates as an output interface and transmits data to another device.

Figure 6:
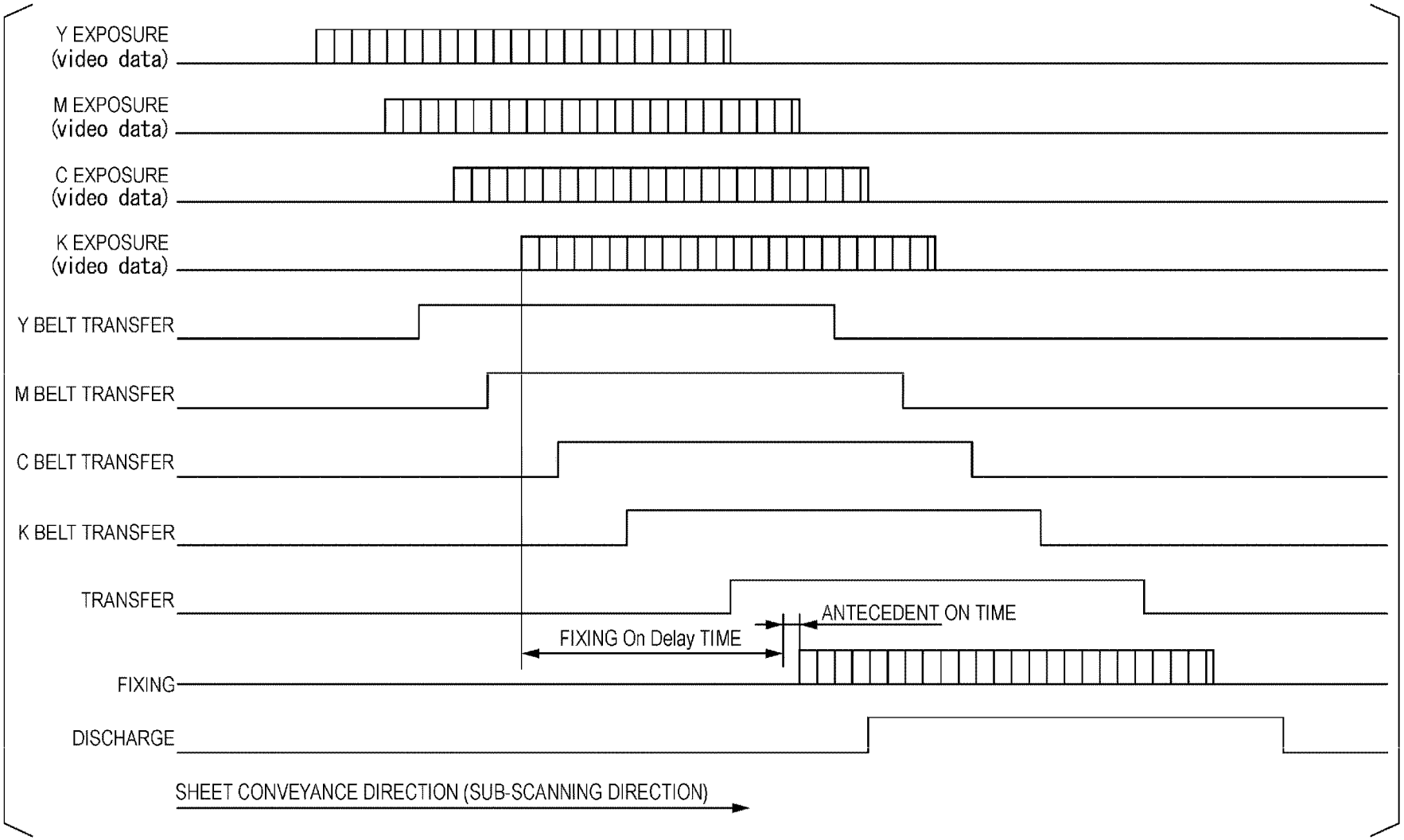
FIG. 6 is a timing chart illustrating a flow of a process from exposure to sheet discharge.

FIG. 6 is a timing chart illustrating a flow of a process from exposure to discharge according to the embodiment. As illustrated in FIG. 6, exposure and transfer timings are different depending on color since a travel distance depends on the different positions of the particular photoconductive drums. As illustrated in FIG. 6, there is some time period from start of exposure of the surface of the photoconductive drum 34K until the fixing starts. The image forming apparatus 1 according to the embodiment begins to heat the heater elements 55 based on the exposure image data used by the image forming unit 30 before the fixing starts. An "antecedent ON time" depicted in FIG. 6 is pre-startup heating timing for a target heater element and represents an amount of time considered appropriate to have the heating target reach its intended temperature after turning on. In FIG. 6, the timing of exposure on the surface of the photoconductive drum 34K is set as a reference, but the embodiment is not limited thereto. For example, a timing of exposure on the surface of any other photoconductive drum 34 may be set as a reference.

Figure 7:
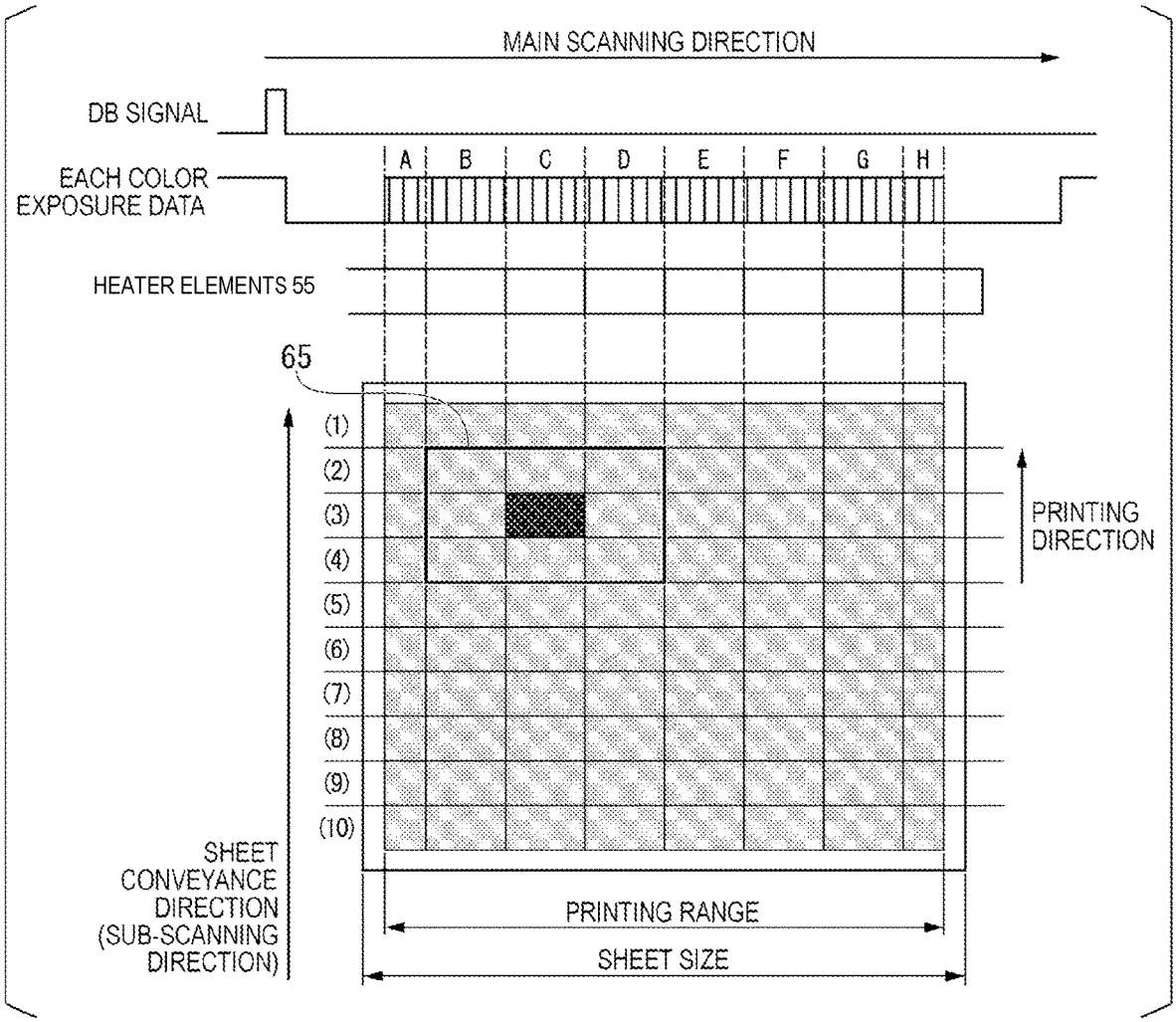
FIG. 7 is a diagram illustrating an example of a correspondence among a pixel count, heater elements, and sub-image regions.

FIG. 7 is a diagram illustrating an example of a correspondence among a pixel count, heater elements, and sub-image regions. The pixel counters 601 to 604 count the number of exposure pixels in each of sub image regions obtained by dividing an image region represented by the exposure image data in the main scanning direction from A to H and in the sub-scanning direction from (1) to (10). Each of the sub-image region includes a plurality of pixels arrayed in both in the main scanning direction and the sub-scanning direction. The exposure pixels are pixels for which a laser scanning beam is generated. When the total number of exposure pixels in one sub-image region is X dots, the maximum number of X dots is four times a count number in a case of four colors. In a sub-image region C-(3) of FIG. 7, a case of the total number of X dots in all the colors (for example, a solid case) is indicated. When the number of exposure pixels is zero in a sub-image region, no heating is performed for the corresponding heater element at the timing when a toner image portion corresponding to the sub-image region comes to the heater element. In an embodiment, when the number of exposure pixels is one or more in a sub-image region, heating is performed for the corresponding heater element at the timing when a toner image portion corresponding to the sub-image region comes to the heater element.

The fixing control circuit 54 may gradually change the manner of energization of the heater elements between the maximum count number (the maximum number of pixels) =X dots×4 and a 0 count. For example, duty control, voltage variation, or the like can be performed as a power variation method.

For example, when duty control is performed, the fixing control circuit 54 may determine a duty ratio of energization of each of the one or more of the heater elements to be energized based on the counted number of exposure pixels in each of the sub-image regions and cause each of the determined one or more of the heater elements to be energized according to the corresponding determined duty ratio. More specifically, the fixing control circuit 54 may determine the duty ratio of energization of a first one of the heater elements to be a first duty ratio, when the counted number of exposure pixels in a first sub-image region corresponding to the first one of the heater elements is a first value, and determine the duty ratio of energization of a second one of the heater elements to be a second duty ratio, when the counted number of exposure pixels in a second sub-image region corresponding to the second one of the heater elements is a second value. The second duty ratio is greater than the first duty ratio, and the second value is greater than the first value.

For example, when the voltage variation is performed, the fixing control circuit 54 may determine a voltage value of energization of each of the one or more of the heater elements to be energized based on the counted number of exposure pixels in each of the sub-image regions, and cause each of the determined one or more of the heater elements to be energized according to the corresponding determined voltage value. More specifically, the fixing control circuit 54 may determine the voltage value of energization of a first one of the heater elements to be a first voltage, when the counted number of exposure pixels in a first sub-image region corresponding to the first one of the heater elements is a first value, and determine the voltage value of energization of a second one of the heater elements to be a second voltage, when the counted number of exposure pixels in a second sub-image region corresponding to the second one of the heater elements is a second value. The second voltage is greater than the first voltage, and the second value is greater than the first value.

In the case of the maximum count value, the fixing control circuit 54 may set not only the same region but also a surrounding region (or adjacent region) as heating targets. For example, when the total number of pixels of a certain region is equal to or greater than a predetermined threshold (for example, the maximum number of pixels), the fixing control circuit 54 determines that a surrounding region (for example, a region 65) including the region therein is also set as a heating target. The fixing control circuit 54 also controls a heating timing of the heater element 55 heating the region which is the determined heating target.

Figure 8:
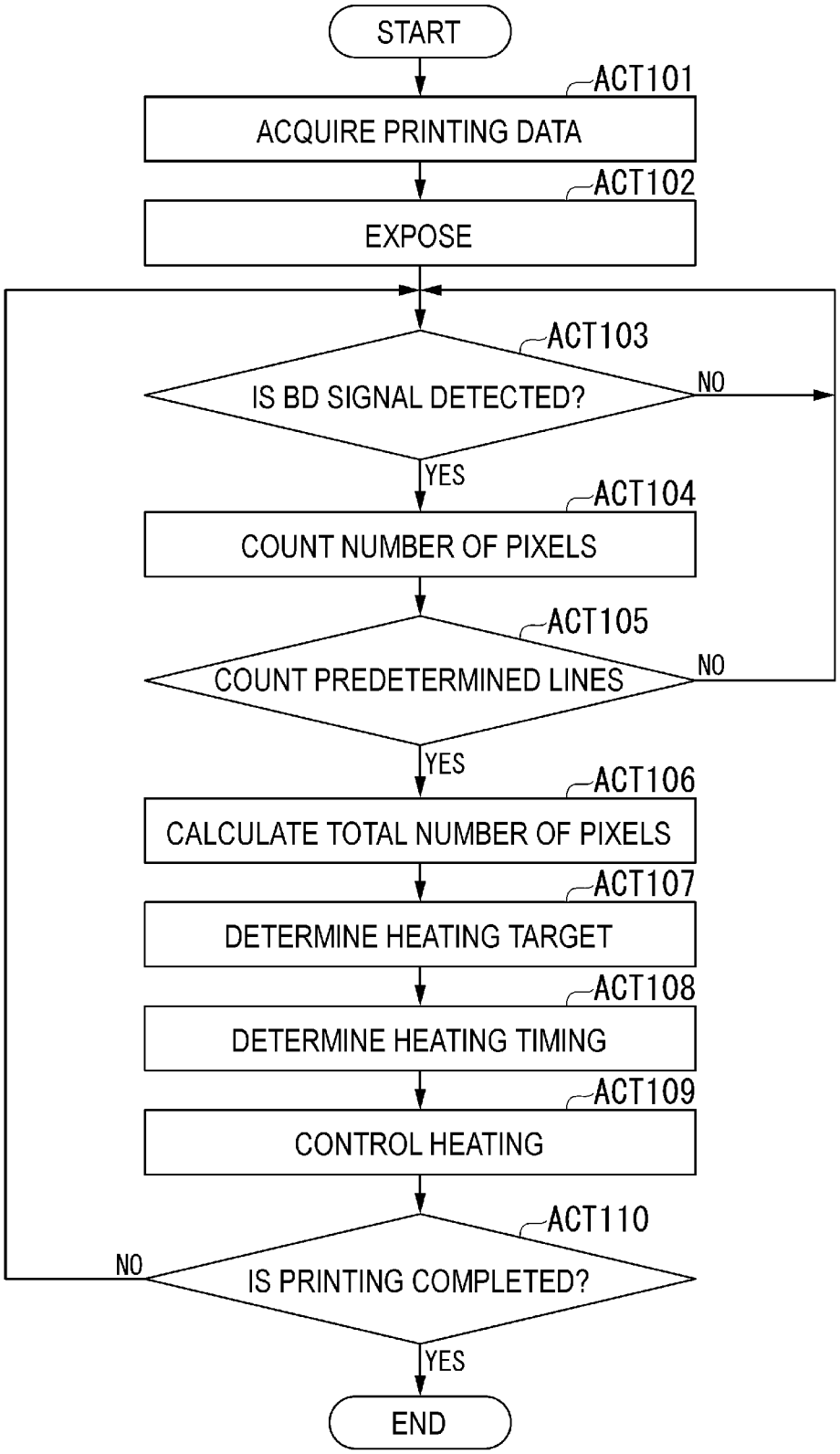
FIG. 8 is a flowchart illustrating a flow of a process performed by the image forming apparatus.

FIG. 8 is a flowchart illustrating a flow of a process performed by the image forming apparatus 1 according to the embodiment.

The control device 70 acquires print data (ACT101) The control device 70 controls the exposure unit 32 to perform exposure by allowing the exposure unit 32 to irradiate the photoconductive drums 34 with laser light based on exposure image data generated based on the print data (ACT102). The beam control unit determines whether the BD signal is detected (ACT103). When the BD signal is not detected (NO in ACT103), the image forming apparatus 1 waits until the BD signal is detected.

Conversely, when the BD signal is detected (YES in ACT103), the beam control unit outputs the detected BD signal to one of the pixel counters 601 to 604.

For example, when the first beam control unit detects the YBD signal, the detected YBD signal is input to the pixel counter 601. For example, when the second beam control unit detects the MBD signal, the detected MBD signal is input to the pixel counter 602. For example, when the third beam control unit detects the CBD signal, the detected CBD signal is input to the pixel counter 603. For example, when the fourth beam control unit detects the KBD signal, the detected KBD signal is input to the pixel counter 604.

The pixel counters 601 to 604 into which the BD signals are input count the number of pixels of one line based on exposure image data (ACT104). In an embodiment, one line may correspond to a pixel in the sub-scanning direction according to the exposure image data. Hereinafter, the pixel counters 601 to 604 into which the BD signals are input are referred to as signal detection pixel counters. The signal detection pixel counters perform counting at the first interval from a time point at which the corresponding BD signal is input. The signal detection pixel counters calculate a sum of the number of pixels of one line in a certain range when the count number at the first interval reaches a preset number.

For example, in the pixel counters 601 to 604, counter values for dividing regions heated by the plurality of heater elements 55-1 to 55-N are set. For example, count values 0 to 100 are set in the region A heated by the heater element 55-1 and counter values 101 to 200 are set in the region B heated by the heater element 55-2. When the counter value reaches 100, the pixel counters 601 to 604 calculate a sum of the number of pixels of one line counted between the counter values 0 to 100. When the counter value reaches 200, the pixel counters 601 to 604 calculate a sum of the number of pixels of one line counted between the counter values 101 to 200. The pixel counters 601 to 604 calculate a sum of the number of pixels of one line for each region heated by the plurality of heater elements 55-1 to 55-N in this way. The pixel counters 601 to 604 output the calculated sum value of the number of pixels of one line to the fixing control circuit 54.

The fixing control circuit 54 determines whether the number of pixels of predetermined lines (for example, five lines) is counted (ACT105). When the number of pixels of the predetermined lines is not counted (NO in ACT105), the fixing control circuit 54 waits until the number of pixels of the predetermined lines is counted.

Conversely, when the number of pixels of the predetermined lines is counted (YES in ACT105), the fixing control circuit 54 calculates the total number of pixels for each certain range (ACT106). For example, the fixing control circuit 54 calculates the total number of pixels of the predetermined lines in the region A heated by the heater element 55-1. This is, for example, a total number of pixels of the predetermined lines in an image region A-(1) illustrated in FIG. 7.

Thereafter, the fixing control circuit 54 determines the heater element which is a heating target based on the calculated total number of pixels of the predetermined lines (ACT107). Specifically, the fixing control circuit 54 determines the heater element 55 in which the calculated total number pixels of the predetermined lines is not 0 as a heater element which is a heating target. The fact that the total number of pixels of the predetermined lines is not 0 means that a certain image is in a region of the predetermined lines.

The fixing control circuit 54 determines a heating timing of the heater element 55 which is a heating target (ACT108). Specifically, the fixing control circuit 54 subtracts a pre-startup time from a delay time of heating of the fixer 50 and sets this timing value as the heating timing for the heater element 55 which is the heating target. The fixing control circuit 54 controls heating of the heater element 55 which is the heating target at the determined timing (ACT109).

Specifically, the fixing control circuit 54 changes power to be given to the heater element 55 which is the heating target in accordance with the total number of pixels. For example, the fixing control circuit 54 changes power given to a heater element 55 by duty ratio control or a voltage variation. Thereafter, the fixing control circuit 54 determines whether the printing is completed (ACT110). When the printing is completed (YES in ACT110), the process of the image forming apparatus 1 ends.

Conversely, when the printing is not completed (NO in ACT110), the image forming apparatus 1 performs the processes after ACT103.

The image forming apparatus 1 having the above-described configuration can shorten a printing startup time (print lead time). More specifically, the image forming apparatus 1 determines a heating start timing for the heater element(s) 55 based on the exposure image data rather than incoming print data itself. Thus, even if image position information from an overall image forming control unit is not received, appropriate heating control can still be achieved. That is, print processing can begin without having to first transfer image position information to the fixing device (or fixing device controller) as is necessary in the related art. The image forming apparatus 1 of the present embodiment can start heating the appropriate heater element(s) 55 before the image position information from the overall image forming control unit is received. Therefore, it is possible to shorten the time before printing starts.

The image forming apparatus 1 also varies power to be given to the heater element 55 heating each region in accordance with the number of pixels of each region. Thus, it is possible to supply appropriate power and achieve energy saving.

Hereinafter, various modification examples of the image forming apparatus 1 will be described.

The image forming apparatus 1 may be a multi-function peripheral that prints with only single color (for example, black (K)). In such a configuration, the image forming apparatus 1 may include one pixel counter 601.

The image forming apparatus 1 according to one embodiment described above includes the heating unit 52, the image forming unit 30, and the fixing control circuit 54. The heating unit 52 includes a plurality of heater elements 55-1 to 55-N (see FIG. 3). The image forming unit 30 performs exposure by irradiating a latent image carrier (e.g., photoconductive drum) with light based on the input image information to the image forming unit 30. The fixing control circuit 54 controls a heating timing of the heater elements 55 which are a heating target based on the exposure image data used by the image forming unit 30. Thus, even before image position information from an overall image forming control unit (e.g., a main printer controller) is received, the heating of the heater elements 55 which are the heating targets can be started. Therefore, it is possible to shorten a printing start time.

Some of the functions of the image forming apparatus 1 according to the above-described embodiments may be performed by a general-purpose computer. In this case, a program to perform the functions can be recorded on a non-transitory computer-readable recording medium. A program recorded on such a recording medium on may be read and executed on a computer system. A "computer system" mentioned herein is assumed to include an operating system and hardware such as peripheral devices. In this context, "computer-readable recording medium" refers to a portable medium or a storage device. The portable medium is, for example, a flexible disc, a magneto-optical disc, a ROM, or a CD-ROM. The storage device is, for example, a hard disk contained in the computer system. In some examples, the "computer-readable recording medium" may be cloud-based or otherwise may be accessed via a network connection or other communication line. In this context, a communication line is, for example, a network such as the Internet or a telephone line. The "computer-readable recording medium" may be a network server or a network client and each of which may be cloud-based or a physical component. The volatile memory retains a program for a given time. The above-described program may be a program that enables the above-described functions in conjunction with a program or programs already stored on the computer system.

While certain embodiments have been described these embodiments have been presented by way of example only, and are not intended to limit the scope of the inventions. Indeed, the novel embodiments described herein may be embodied in a variety of other forms; furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming device configured to receive image data and irradiate a laser beam based on the image data to form a toner image;

a heater configured to heat a sheet, the heater including a plurality of heater elements arranged in a first direction perpendicular to a second direction in which the sheet is conveyed to fix the toner image onto the sheet; and a controller configured to:

count a number of exposure pixels in each of a plurality of sub-image regions based on the image data, the sub-image regions corresponding to divisions of an image region in the first direction and the second direction; and selectively control the heater elements to be energized at an energization timing based on the counted number of exposure pixels in each of the sub-image regions.

2. The image forming apparatus according to claim 1, wherein the image data comprises binary image data of a first color and binary image data of a second color, and the controller is configured to:

count a number of first-color exposure pixels in each of the sub-image regions based on the binary image data of the first color;

count a number of second-color exposure pixels in each of the sub-image regions based on the binary image data of the second color; and count the number of exposure pixels as a sum of at least the number of first-color exposure pixels and the number of second-color exposure pixels.

3. The image forming apparatus according to claim 1, wherein positions of the heater elements along the first direction respectively correspond to positions of sub-image regions along the first direction.

4. The image forming apparatus according to claim 3, wherein the controller is configured to:

determine a first one of the heater elements to be not energized at a first timing when a first toner image portion corresponding to a first sub-image region that includes no exposure pixel therein is conveyed to face the first one of the heater elements; and determine a second one of the heater elements to be energized at a second timing when a second toner image portion corresponding to a second sub-image region that includes at least one exposure pixel therein is conveyed to face the second one of the heater elements.

5. The image forming apparatus according to claim 3, wherein the controller is further configured to:

determine a duty ratio of energization for each of the heater elements.

6. The image forming apparatus according to claim 3, wherein the controller is further configured to:

determine a voltage level for energization of each of the heater elements.

7. A method for controlling an image forming apparatus including:

an image forming device configured to receive image data and irradiate a laser beam based on the image data to form a toner image;

a heater configured to heat a sheet, the heater including a plurality of heater elements arranged in a first direction perpendicular to a second direction in which the sheet is conveyed to fix the toner image onto the sheet; and a controller configured to selectively control the heater elements to be energized at an energization timing based on the image data, the method comprising:

counting a number of exposure pixels in each of a plurality of sub-image regions based on the image data, the sub-image regions corresponding to divisions of an image region in the first direction and a second direction; and selecting a heater element to be energized at an energization timing based on the counted number of exposure pixels in each of the sub-image regions.

8. The method according to claim 7, wherein the image data comprises binary image data of a first color and binary image data of a second color, and the counting of the number of exposure pixels comprises:

counting a number of first-color exposure pixels in each of the sub-image regions based on the binary image data of the first color;

counting a number of second-color exposure pixels in each of the sub-image regions based on the binary image data of the second color; and summing the number of first-color exposure pixels and the number of second-color exposure pixels.

9. The method according to claim 7, wherein positions of the heater elements along the first direction respectively correspond to positions of sub-image regions along the first direction.

10. The method according to claim 9, further comprising:

determining a first one of the heater elements to be not energized at a first timing when a first toner image portion corresponding to a first sub-image region that includes no exposure pixel therein is conveyed to face the first one of the heater elements; and determining a second one of the heater elements to be energized at a second timing when a second toner image portion corresponding to a second sub-image region that includes at least one exposure pixel therein is conveyed to face the second one of the heater elements.

11. The method according to claim 9, further comprising:

determining a duty ratio of energization for each of the heater elements.

12. The method according to claim 9, further comprising:

determining a voltage level for energization of each of the heater elements.

13. An image forming apparatus, comprising:

an image forming device configured to receive image data and transfer a toner image to a sheet, the toner image corresponding to the image data and being formed from an electrostatic latent image formed on a photoconductive drum by selectively exposing the photoconductive drum in a first direction while the photoconductive drum rotates in a second direction which is perpendicular to the first direction;

a fixing device configured to receive the sheet from the image forming device and heat the sheet with the toner image thereon, the fixing device including a plurality of heater elements arranged along a direction corresponding to the first direction; and an engine controller configured to control the fixing device so as to selectively control the heater elements to be energized at an energization timing based on the image data, the energization timing corresponding to the time for the sheet to be transported from the image forming device to the fixing device.

14. The image forming apparatus according to claim 13, wherein the energization time accounts for a pre-startup timing of the heater element.

15. The image forming apparatus according to claim 13, wherein the image forming apparatus is configured to form a multicolor toner image.

16. The image forming apparatus according to claim 13, wherein the engine controller includes a pixel counter configured to count the number of exposure pixels in a sub-image region including portions of at least two different lines of the image data in the first direction.

17. The image forming apparatus according to claim 13, wherein the engine controller is configured to determine a duty ratio of energization for each of the heater elements.

18. The image forming apparatus according to claim 13, wherein the engine controller is configured to determine a voltage level for energization of each of the heater elements.

* * * * *